US006805530B1

(12) United States Patent
Urban

(10) Patent No.: US 6,805,530 B1
(45) Date of Patent: Oct. 19, 2004

(54) CENTER-LOCATED CUTTER TEETH ON SHROUDED TURBINE BLADES

(75) Inventor: John Paul Urban, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/418,116

(22) Filed: Apr. 18, 2003

(51) Int. Cl.[7] ..... F01D 5/20
(52) U.S. Cl. ..... 415/173.4; 415/173.6; 415/174.4
(58) Field of Search ..... 415/173.4, 173.6, 415/174.4; 416/192, 191

(56) References Cited

U.S. PATENT DOCUMENTS 5,083,903 A * 1/1992 Erdmann ..... 416/190
5,238,364 A * 8/1993 Kreitmeier ..... 415/173.1
5,290,144 A * 3/1994 Kreitmeier ..... 415/173.1
6,506,022 B2 1/2003 Bunker

* cited by examiner

*Primary Examiner*—Ninh H. Nguyen
(74) *Attorney, Agent, or Firm*—Nixon & Vanderhye

(57) ABSTRACT

The shroud includes a seal extending continuously between leading and trailing edges of the shroud at the tip of the airfoil. A cutter tooth is provided substantially medially of the shroud and in substantial radial alignment with a line through the center of mass of the airfoil. In this manner, any moment arm generated by movement of the shroud is eliminated or minimized to reduce the stresses in the fillet region between the shroud and the airfoil tip and hence increase the creep life of the bucket.

15 Claims, 3 Drawing Sheets

CENTER-LOCATED CUTTER TEETH ON SHROUDED TURBINE BLADES

BACKGROUND OF THE INVENTION

The present invention relates to turbine buckets having airfoil tip shrouds and particularly relates to a shroud having a tip seal and a cutter tooth located intermediate opposite ends of the shroud in the direction of rotation of the bucket.

Airfoils on turbine buckets are frequently provided with tip shrouds. The shroud prevents failure of the airfoil in high cycle fatigue due to vibratory stresses. Seals are typically provided which project radially outwardly from the outer surfaces of the shrouds and extend between opposite ends of the shrouds in the direction of rotation of the turbine rotor. The tip shroud seals conventionally extend into a groove formed in a stationary shroud opposing the rotating tip shroud. The stationary shroud has a honeycomb pathway. Rather than providing a zero tolerance seal between the tip shroud and the stationary shroud, resulting in instability of the airfoil, it has been found desirable to provide a leakage path over the tip shroud seal which will remove such instability. Typically, a cutter tooth is provided at the leading edge of the tip shroud to cut a wider groove in the honeycomb of the stationary shroud than the width of the tip seal. This enables leakage flow between the high and low pressure regions on opposite sides of the seal extending in the groove. While this disadvantageously results in a decrease in pressure drop across the airfoil with resulting diminishment of sealing capability, the sacrifice in efficiency is compensated by the increase in stability of the airfoil.

However, because the mass of the tooth is not located in the same radial line as the center of mass of the airfoil, it has been discovered that a high stress is induced along the fillet region between the airfoil and the tip shroud. This increased stress at high temperatures leads to a high creep rate on the shroud and ultimately can result in failure of the shroud, for example, by cracking or splitting. It will be appreciated that the failure of a single bucket shroud causes the turbine necessarily to be taken off-line. Consequently, shroud failure due to increased stress at the fillet region between the tip shroud and the airfoil requires time-consuming and costly repairs, including bringing the turbine off-line, i.e., downtime, in addition to the labor and replacement parts necessary to effect the repair.

BRIEF DESCRIPTION OF THE INVENTION

In accordance with a preferred embodiment of the present invention, the cutter tooth on the airfoil tip shroud is located intermediate the opposite ends of the shroud and preferably in substantial radial alignment with the center of mass of the airfoil. The cutter tooth is thus located substantially medially of the length of the shroud in the circumferential direction and closely adjacent to a radial line through the center of mass of the blade. Consequently, the cutter tooth in the center of the shroud enables the mass of the cutter tooth to be more in coincidence with the radial line intersecting the center of mass of the airfoil. This, in turn, minimizes the moment generated by the additional mass of the cutter tooth, resulting in lower fillet stress. The reduced stress extends creep life of the fillet which is frequently the life-limiting location of the part.

In a preferred embodiment according to the present invention, there is provided a turbine bucket comprising an airfoil having a tip shroud, a seal projecting radially outwardly from the shroud and extending continuously between end edges of the shroud in a direction of rotation of the airfoil about a turbine axis, a cutter tooth carried by the shroud and projecting to at least one side of the seal in a direction generally normal to the turbine axis for cutting a groove in an opposing fixed shroud, the cutter tooth having a discrete length in the direction of the seal shorter than the length of the seal and located intermediate the ends of the shroud.

In a further preferred embodiment according to the present invention, there is provided a turbine bucket comprising an airfoil having a tip shroud, a seal projecting radially outwardly from the shroud and extending continuously between end edges of the shroud in a direction of rotation of the airfoil about a turbine axis, a cutter tooth carried by the shroud and projecting to at least one side of the seal in a direction generally normal to the turbine axis for cutting a groove in an opposing fixed shroud, the cutter tooth having a discrete length in the direction of the seal shorter than the length of the seal and located substantially medial of the length of the seal.

In a further preferred embodiment according to the present invention, there is provided a turbine bucket comprising an airfoil having a tip shroud, a seal projecting radially outwardly from the shroud and extending continuously between end edges of the shroud in a direction of rotation of the airfoil about a turbine axis, a cutter tooth carried by the shroud and projecting to at least one side of the seal in a direction generally normal to the turbine axis for cutting a groove in an opposing fixed shroud, the cutter tooth having a discrete length in the direction of the seal shorter than the length of the seal and lying substantially in radial alignment with a radial line through the center of mass of the airfoil.

DETAILED DESCRIPTION OF THE INVENTION

Figure 1:
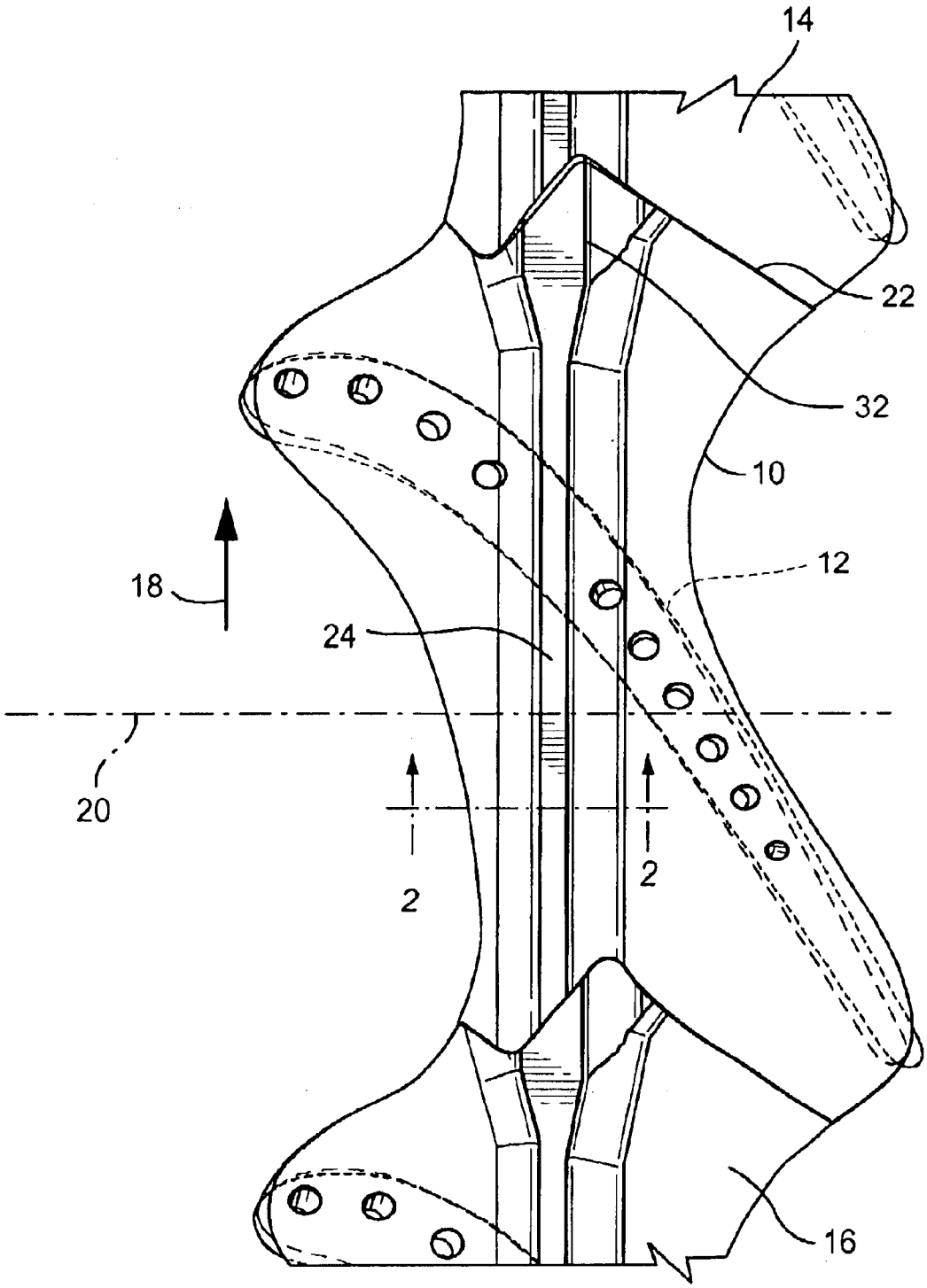
Fig. 1 (Prior Art)
FIG. 1 is a radial inward view of a shroud having a seal and a cutter tooth in accordance with the prior art.

Referring now to FIG. 1, there is illustrated a shroud 10 mounted on the tip of an airfoil 12. Shroud 10 is illustrated between adjacent shrouds 14 and 16 on the tips of adjacent airfoils. The direction of rotation of the airfoil 12 and bucket of which it forms a part is indicated by the arrow 18, the axis of rotation being indicated by the arrow 20. It will be appreciated that the adjacent shrouds are not connected one to the other. Rather, the adjacent shrouds bear against one another in their registering end configurations 22.

Figure 2:
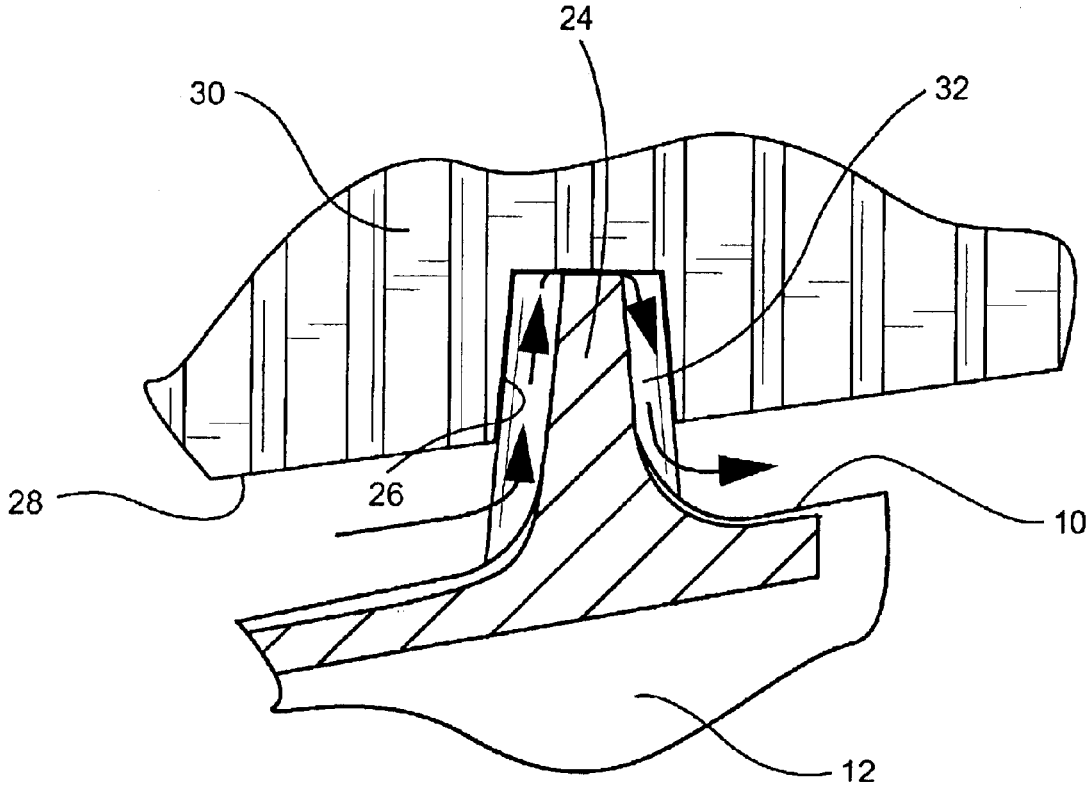
Fig. 2 (Prior Art)
FIG. 2 is a cross-sectional view thereof taken generally about on line 2-2 of FIG. 1.

Referring to FIGS. 1 and 2, the shroud 10 includes a generally radially directed seal 24 for sealing in a groove 26 formed in an adjacent stationary shroud 28 (FIG. 2). Typically, the stationary shroud includes a honeycomb structure 30. Consequently, the seal 24 affords a differential pressure on opposite sides of the airfoils 12.

To remove airfoil instabilities caused by the seal 24 engaging in the honeycomb 30, and to create a linkage path between high and low pressure regions on opposite sides of seal 24, a cutter tooth 32 is formed at the leading edge of the shroud 10 in the direction of rotation of the rotor. The cutter tooth 32 constitutes a lateral enlargement on opposite sides of the seal 24 at the leading edge of the seal and shroud in the direction of rotation. Thus, the cutter tooth 32 enlarges the axial extent or width of the groove 26 in the honeycomb of the stationary shroud whereby a leakage path indicated by the arrows in FIG. 2 is provided across the seal 24 in regions other than the cutter tooth 32. The leakage path creates a small reduction in the pressure differential and consequent loss of efficiency which, however, is compensated for by increased stability and improved creep life due to reduction of stresses.

Figure 3:
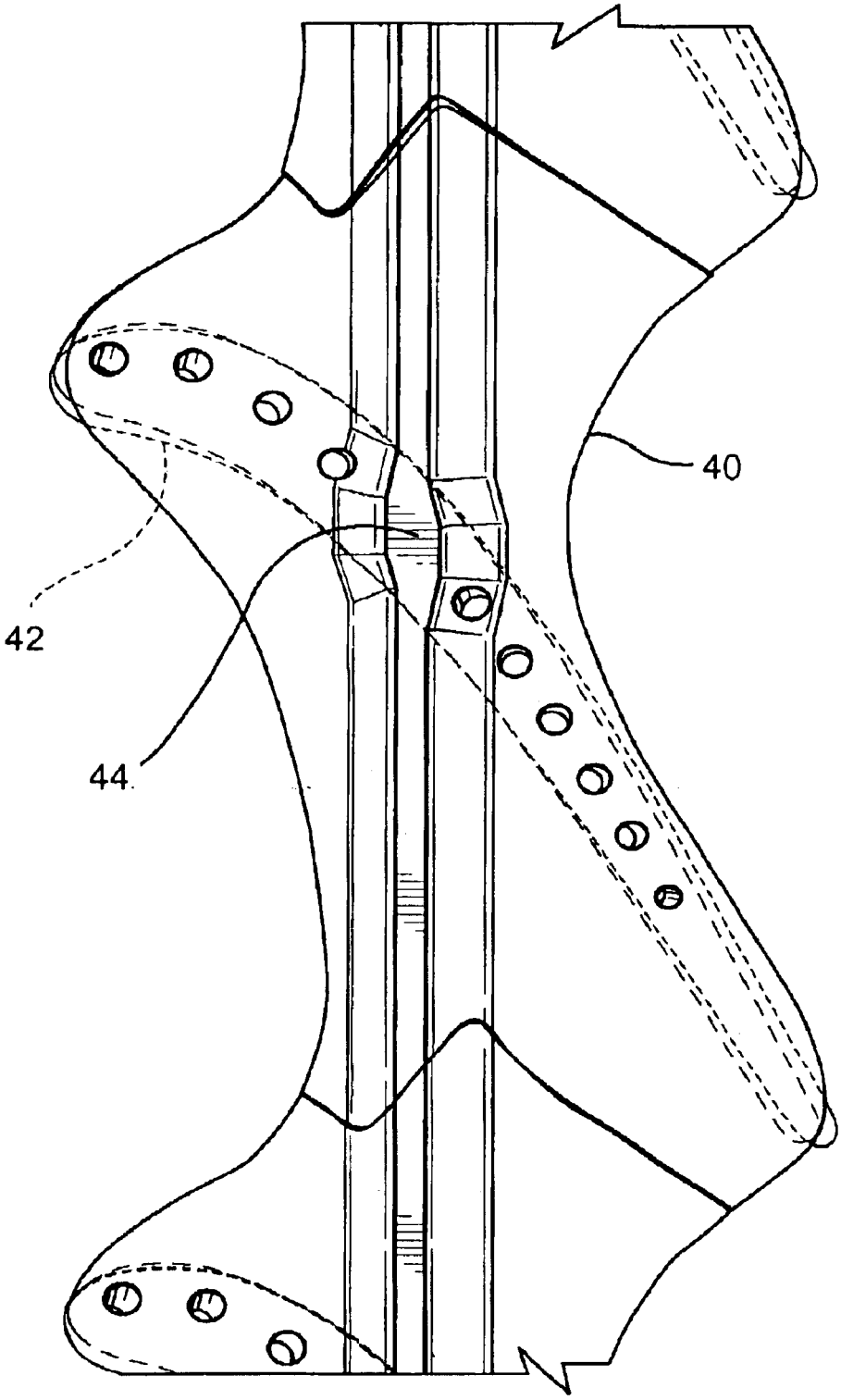
FIG. 3 is a view similar to FIG. 1 illustrating the location of the cutter tooth in accordance with a preferred embodiment of the present invention.

Referring now to FIG. 3 and in accordance with a preferred embodiment of the present invention, there is provided a shroud 40 similarly mounted on the tip of an airfoil 42. The leading and trailing edges of the shroud 40 are formed similarly as in the prior art of FIG. 1. In this embodiment, however, the cutter tooth 44 lies intermediate the opposite ends of the shroud 40 and preferably substantially medially of the length of the shroud 40. As illustrated, the cutter tooth 44 radially overlies a central portion of the airfoil 42. In this manner, the cutter tooth 44 is in substantial radial alignment with a radial line intersecting the center of mass of the airfoil. This minimizes any moment generated by the additional mass of a cutter tooth and, consequently, results in lower fillet stress at the juncture of the shroud and the tip of the airfoil. Lower fillet stress, in turn, extends creep life which is often the part's life-limiting location.

The function of the cutter tooth 44 is the same as the cutter tooth 26 of the prior art. However, the location of the cutter tooth 44 substantially medially of the shroud and substantially in line with a radius through the center of mass of the airfoil provides not only the benefits of the prior cutter tooth but also reduces the stress in the fillet region and thereby increases the creep life.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket comprising:

an airfoil having a tip shroud;

a seal projecting radially outwardly from said shroud and extending continuously between end edges of the shroud in a circumferential direction of rotation of said airfoil about a turbine axis;

a cutter tooth carried by said shroud along said seal and projecting to at least one side of said seal in a direction generally parallel to the turbine axis for cutting a groove, generally conforming to the cutter tooth projection in an opposing fixed shroud;

said cutter tooth having a discrete length in the direction of the seal shorter than the length of the seal and located intermediate the ends of the shroud.

2. A turbine bucket according to claim 1 wherein said cutter tooth is located substantially medial of the length of the seal.

3. A turbine bucket according to claim 1 wherein said cutter tooth is located in radial alignment with a portion of said airfoil.

4. A turbine bucket according to claim 1 wherein said cutter tooth projects to an opposite side of the seal.

5. A turbine bucket according to claim 1 wherein said cutter tooth is located substantially medial of the length of the seal, said cutter tooth projecting to an opposite side of the seal.

6. A turbine bucket according to claim 1 wherein said cutter tooth is located in radial alignment with a portion of said airfoil, said cutter tooth projecting to an opposite side of the seal.

7. A turbine bucket according to claim 1 wherein said cutter tooth lies substantially in radial alignment with a radial line through the center of mass of the airfoil.

8. A turbine bucket comprising:

an airfoil having a tip shroud;

a seal projecting radially outwardly from said shroud and extending continuously between end edges of the shroud in a circumferential direction of rotation of said airfoil about a turbine axis;

a cutter tooth carried by said shroud along said seal and projecting to at least one side of said seal in a direction generally parallel to the turbine axis for cutting a groove, generally conforming to the cutter tooth projection in an opposing fixed shroud;

said cutter tooth having a discrete length in the direction of the seal shorter than the length of the seal and located substantially medial of the length of the seal.

9. A turbine bucket according to claim 8 wherein said cutter tooth is located in radial alignment with a portion of said airfoil.

10. A turbine bucket according to claim 8 wherein said cutter tooth projects to an opposite side of the seal.

11. A turbine bucket according to claim 8 wherein said cutter tooth is located in radial alignment with a portion of said airfoil, said cutter tooth projecting to an opposite side of the seal.

12. A turbine bucket according to claim 8 wherein said cutter tooth lies substantially in radial alignment with a radial line through the center of mass of the airfoil.

13. A turbine bucket comprising:

an airfoil having a tip shroud;

a seal projecting radially outwardly from said shroud and extending continuously between end edges of the shroud in a circumferential direction of rotation of said airfoil about a turbine axis;

a cutter tooth carried by said shroud along said seal and projecting to at least one side of said seal in a direction generally parallel to the turbine axis for cutting a groove in an opposing fixed shroud;

said cutter tooth having a discrete length in the direction of the seal shorter than the length of the seal and lying substantially in radial alignment with a radial line through the center of mass of the airfoil.

14. A turbine bucket according to claim 13 wherein said cutter tooth is located substantially medial of the length of the seal.

15. A turbine bucket according to claim 13 wherein said cutter tooth projects to an opposite side of the seal.

* * * * *